US006869565B1

(12) United States Patent
Jones et al.

(10) Patent No.: US 6,869,565 B1
(45) Date of Patent: Mar. 22, 2005

(54) INTEGRATED SURFACE COMPOSITIONS AND ARTICLES MADE THEREFROM

(75) Inventors: Roger D. Jones, Youngstown, OH (US); David Hofmann, Youngstown, OH (US)

(73) Assignee: Fireline, Inc.

( * ) Notice: Subject to any disclaimer, the term of this patent is extended or adjusted under 35 U.S.C. 154(b) by 64 days.

(21) Appl. No.: 10/128,080

(22) Filed: Apr. 23, 2002

Related U.S. Application Data

(60) Provisional application No. 60/285,821, filed on Apr. 23, 2001.

(51) Int. Cl.[7] ..... C21B 7/00
(52) U.S. Cl. ..... 266/275; 266/280; 501/103
(58) Field of Search ..... 266/275, 280, 266/286; 501/103; 432/265

(56) References Cited

U.S. PATENT DOCUMENTS 5,335,833 A 8/1994 Rancoule ..... 222/600
5,370,370 A 12/1994 Benson ..... 266/236
5,373,976 A 12/1994 Rancoule et al. ..... 222/600
5,403,794 A 4/1995 Morris et al. ..... 501/105
5,972,102 A * 10/1999 Vezza ..... 106/692

FOREIGN PATENT DOCUMENTS

JP 363265870 A * 11/1988

OTHER PUBLICATIONS

English language Translation of Japanese 63265870 A, Nov. 2, 1988.*

* cited by examiner

*Primary Examiner*—Scott Kastler
(74) *Attorney, Agent, or Firm*—H. Jay Spiegel

(57) ABSTRACT

The present invention relates to an article having an integrated contact surface, such as a melting vessel, and compositions for forming the article. The composition for forming the articles, such as melting vessels, includes from about 25% to about 99% binder material including clay and zirconia or a blend of alumina and zirconia. The composition also includes from about 1% to about 75% by weight of a filler material. The surface of the an article formed from the composition, such as a melting vessel, essentially is comprised of the binder material. The body of the melting vessel includes a blend of binder material and filler material. The present invention also relates to a process for making an article, such as a melting vessel from the composition.

23 Claims, 1 Drawing Sheet

INTEGRATED SURFACE COMPOSITIONS AND ARTICLES MADE THEREFROM

This application claims the benefit of the filing date of U.S. Provisional Application No. 60/285,821 filed on Apr. 23, 2001.

FIELD OF INVENTION

The present invention relates to compositions and melting vessels formed from the compositions for use in casting molten metals. The present invention also relates to processes for forming melting vessels for use in casting molten metals.

BACKGROUND OF THE INVENTION

Melting vessels are used in the metal casting industry, in particular the investment casting industry, to melt metals wherein the molten metal is then cast into particular shapes. Melting vessels are typically formed from a refractory material composition, which are any of various substances, such as ceramics, that are characterized by their suitability for use as structural materials at high temperatures. Refractory materials are particularly useful for casting reactive or corrosive materials including metals.

In the metal casting industry, a common problem during molten metal casting is the reactivity of molten metal with the refractory material composition of the melting vessel. Conventional melting vessels can undesirably react with molten metal which causes, among other things, metal contamination and ceramic inclusions in cast metal articles.

It would be desirable to form a composition and a melting vessel therefrom that exhibits improved low metal reactivity properties over conventional compositions and melting vessels. It would also be desirable to heat the composition forming the melting vessel at a relatively lower temperature than the temperature required to form conventional melting vessels which, in turn would substantially reduce the manufacturing costs associated with producing the melt ing vessel.

SUMMARY OF THE INVENTION

In one aspect, the present invention is directed to a melting vessel. The melting vessel includes from about 25% to about 99% by weight of a binder material. The binder material comprises zirconia or a blend of alumina and zirconia. Optionally, the binder may also include other conventional binder materials such as clay. The melting vessel can further include from about 1% to about 75% by weight of filler material. At least about 85% of a surface of the melting vessel includes binder material which forms an integrated contact surface on the molded article.

In another aspect, the present invention is directed to a composition for a melting vessel having an integrated contact surface formed thereon. The composition includes from about 25% to about 99% by weight of a binder material. In an alliterative embodiment, the composition includes from about 60% to about 75% by weight of a binder material. The binder material includes zirconia or a blend of alumina and zirconia. Optionally, the binder may include other conventional binder materials, for example, clay. The composition further can include from about 1% to about 75% to, alternatively, from about 25% to about 40% by weight of a filler material.

In a further aspect, the present invention is directed to a process for forming a melting vessel having an integrated contact surface formed thereon. The process includes the step of forming a composition. The composition includes from about 25% to about 99% by weight of a binder material. The binder material comprises zirconia or a blend of alumina and zirconia. Optionally, the binder may include other conventional binders such as, for example, clay. The composition further includes from about 1% to about 75% by weight of a filler material. The process further includes the step of firing the composition at a temperature from about 2050° F. to about 2300° F. Upon firing of an article molded from the composition, an article having an integrated contact surface comprised of zirconia or a blend of zirconia and alumina and/or other binders, is created.

In yet a further aspect, the present invention is directed to a melting vessel formed from a composition. The melting vessel includes from about 60% to about 75% by weight of a binder material. The binder material includes alumina, zirconia, and clay. The article further includes from about 25% to about 40% by weight of a filler material. The filler material includes at least one of fused mullite and fused silicon or a blend thereof. At least about 85% of a surface of the article comprises the binder material.

DETAILED DESCRIPTION OF THE PREFERRED EMBODIMENTS

Figure 1:
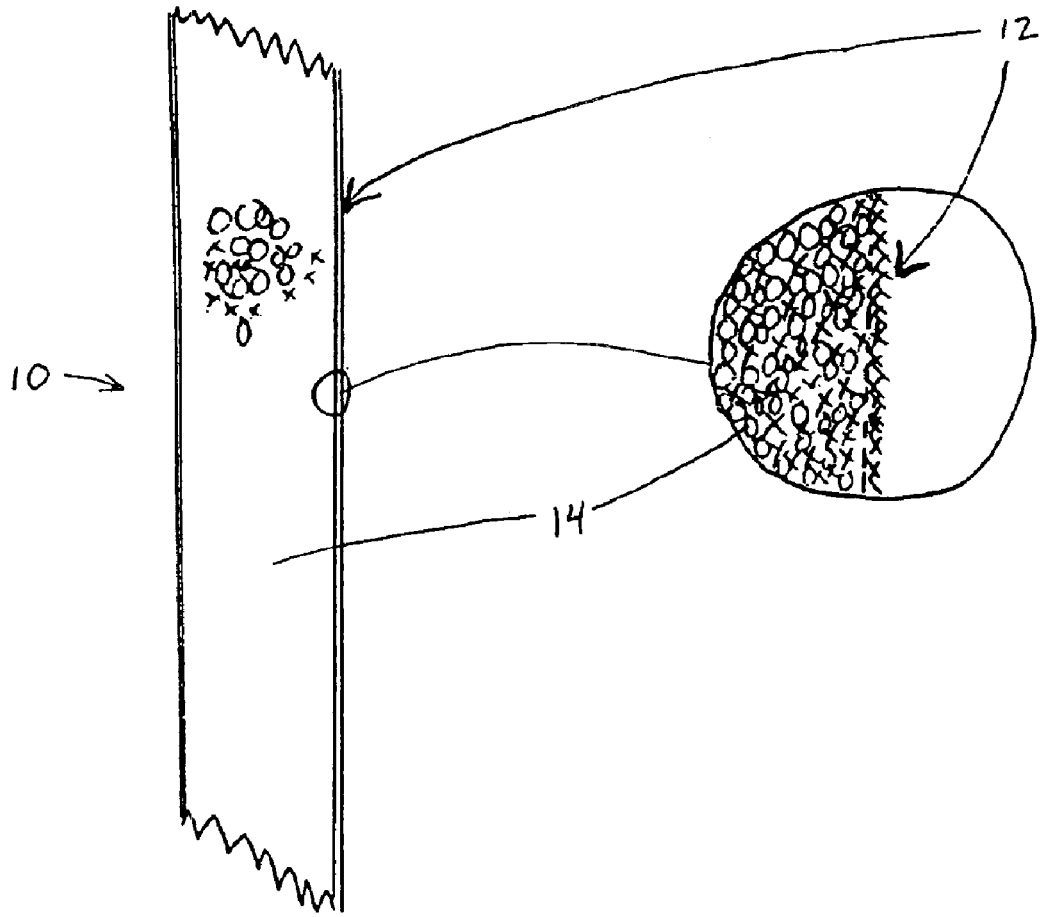
FIG. 1 shows a cross-sectional view and a blown-up cross-sectional view of a melting vessel.

The present invention is directed to compositions which, when forming a melting vessel, possess an integrated contact surface. The composition includes a binder material comprising zirconia or a blend of alumina and zirconia. The binder material may further include additional binder materials such as clay. The composition further can include one or more filler materials. The present invention is also directed to a process for forming a melting vessel having an integrated contact surface formed thereon.

The compositions of the present invention provide the articles formed therefrom with a surface that exhibits low reactivity properties to molten metals referred to herein as an integrated contact surface. This low-reactive surface is essentially comprised of particles of the binder material which is in a continuous phase throughout the entire body of the article. This, in turn, imparts uniform thermal properties throughout the article.

The integrated contact surface of an article formed from the compositions of the present invention comprises at least about 80% of the binder particles. Preferably, the integrated contact surface comprises at least about 85% of the binder particles. More preferably, the integrated contact surface comprises at least about 90% of the binder particles. Even more preferably, the integrated contact surface comprises at least about 95% of the binder particles.

It is important to recognize that the binder materials of the present invention, while acting as conventional binders, produce the highly desirable integrated contact surface on articles fromed therefrom wherein said integrated contact surface is non-reactive with molten metals.

The binder material includes zirconia or a blend of alumina and zirconia. The alumina and zirconia particles are preferably of a fine grade material. The alumina particles have a mean particle size of from about 0.1 microns to about 10 microns, preferably from about 1 micron to about 5 microns, and most preferably about 3 microns. Typically, the zirconia particles have a mean particle size of from about 0.1 micron to about 20 microns, preferably from about 5 microns to about 15 microns, and most preferably about 8 microns. Alumina and zirconia particles having such a relatively small size allow the composition which forms the articles, such as melting vessels, to be sintered or formed to full density at relatively low temperatures as compared to compositions having larger size particles.

Optionally, additional synthetic and naturally occurring binder materials may be present in the compositions of the invention including, but not limited to, metal oxides, clays, other conventional binder materials, mixtures of these and the like. Preferably clay is included as an additional binder material. Particular examples of clays which may be employed include high purity kaolin, and ball clay.

In one embodiment according to the present invention, the binder material includes a blend of clay and zirconia or a blend of clay and alumina and zirconia. The binder material, including clay and either zirconia or a blend of alumina and zirconia, comprises from about 25% to about 99% by weight of the composition used to form the article. In another embodiment, the composition comprises from about 50% to about 80% by weight of the binder material. In a further embodiment, the composition comprises from about 60% to about 75% by weight of the binder material. The remainder of the composition can be filler.

When the binder material includes a blend of clay and either zirconia or a blend of alumina and zirconia, the composition includes from about 10% to about 99% by weight of either zirconia or a blend of alumina and zirconia. In one embodiment, the composition includes from about 40% to about 80% by weight of either zirconia or a blend of alumina and zirconia. In another embodiment, the composition includes from about 50% to about 75% by weight of either zirconia or a blend of alumina and zirconia. When the composition includes clay and either zirconia or a blend of alumina and zirconia, the composition includes from about 1% to about 10% by weight of clay. In a further embodiment, the composition includes from about 1% to about 5% by weight of clay.

In another preferred embodiment according to the present invention, the binder material includes a blend of alumina, zirconia and clay. When the composition includes a binder material blend of alumina, zirconia, and clay, the composition includes from about 1% to about 75% by weight of alumina; from about 1% to about 75% by weight of zirconia; and from about 1% to about 10% by weight of clay. In a further embodiment, the composition includes from about 5% to 50% by weight of alumina; from about 15% to about 60% by weight of zirconia; and from about 1% to about 5% by weight of clay.

The compositions of the present invention, and articles formed therefrom, such as melting vessels, can further comprise a filler material or materials. The interior or body of the melting vessel formed from the composition includes most of the filler material integrated with the binder material. In one embodiment, the composition includes form about 1% to about 75% by weight of filler material. In a further embodiment, the composition includes from about 20% to 50% by weight of filler material. In yet a further embodiment, the composition includes from about 25% to about 40% by weight of filler material.

Filler materials used in accordance with the present invention include any conventional filler materials known to those skilled in the art. Such filler materials include, but are not limited to, mullite, fused mullite, silica, fused silica, fosterite, cordierite, zircon, mixtures thereof or the like. Fused silica is typically utilized due to its purity and low thermal expansion properties. Also, fused mullite is used due to its purity and superior high temperature properties. The filler materials preferably have a particle size of from about 4 mesh to about 325 mesh.

An additional conventional additive to casting compositions, and in particular slip casting compositions, includes one or more deflocculants. An example of a deflocculant useable in the composition of the present application includes, but is not limited to, sodium polyacrylate. The deflocculant is typically present in an amount of from about 0.01% to about 0.3%. Preferably, the deflocculant is present in an amount of from about 0.06% to about 0.25%. Most preferably the deflocculant is present: in an amount of about 0.1%. The amount of deflocculant can be adjusted accordingly to prepare a final formulation with the desired properties necessary to form the integrated contact surface. Other conventional additives which are optional in the composition of the invention include surfactants, wetting agents and the like where such additives do not affect the desired non-reactive surface forming properties of the compositions set forth herein.

The compositions of the present invention are useful for forming articles where resistance to attack by molten metals is critical. Such uses include, but are not limited to, single and multiple use melting vessels or crucibles, melting liners, back-up crucibles, crucible liners, transfer ladles and other accessories containing refractory materials used in investment casting processes and other conventional casting processes used with molten metals. The term "melting vessels" as used herein is intended to be representitive of all types of articles used in investment casting and other casting processes as previously described herein. Such melting vessels are typically used for molten metals. In particular, the non-reactive integrated contact surface of a vessel formed from the compositions of the invention will provide a surface which is non-melting and non-reactive to molten metals.

FIG. 1 shows a cross-sectional view of a melting vessel 10 formed in accordance with the present invention. A blow-up view of the cross-section of the article 10 shows the composition of the surface 12 and body or interior 14 of the article. An "X" denotes binder material, whereas an "O" denotes filler material. The surface 12 of the article 10 is essentially binder material and includes trace amounts, if any, of filler material. Preferably, at least about 85% of the surface of the article includes binder material. More preferably, at least about 90% of the surface of the article includes binder material. Most preferably, at least about 95% of the surface of the article includes binder material. The surface 12 of the article 10 provides the article 10 with a non-reactive integrated contact surface exhibiting low reactivity properties when in contact with molten metal. The body 14 of the article 10 includes a blend of filler and binder materials. The blend of binder and filler materials in the body 14 strengthens the article 10 and prevents accidental cracking or breakage of the article 10 during molten metal molding.

Once the composition that forms the melting vessels of the present invention is made and formed into melting vessels by conventional processes, the articles can be can be fired at comparatively lower temperatures than known compositions. Typically, an article formed from the compositions of the present invention can be fired at about 2050° F. to about 2300° F., preferably about 2150° F. The articles formed from the compositions have a hold time sufficient for the composition to reach thermal equilibrium, and a cycle time of from about 16 hours to 24 hours (cold to cold). Such a process produces articles having the desired non-reactive integrated contact surface and integral strength advantages of the present invention. Conventional methods of forming articles from the compositions of the present invention include, but are not limited to, solid slip casting, drain slip casting and pressure casting processes.

The following examples are for illustrative purposes only and are not intended to be limiting.

EXAMPLES 1–6

A series of six compositions were prepared with the materials set forth in Table 1 below. Each material set forth in Table 1 below is in weight percent

TABLE 1

| Ingredients (wt %) | #1 | #2 | #3 | #4 | #5 | #6 |
|---|---|---|---|---|---|---|
| Fused Silica | 26.3 | 27.2 | 30.6 | 0.0 | 0.0 | 30.6 |
| Fused Mullite | 0.0 | 0.0 | 0.0 | 38.6 | 34.9 | 0.0 |
| Calcined Alumina* | 0.0 | 8.2 | 38.6 | 34.2 | 7.3 | 38.7 |
| Zirconia** | 69.8 | 60.6 | 26.3 | 23.2 | 54.2 | 26.2 |
| Clay | 3.8 | 3.9 | 4.4 | 4.9 | 3.5 | 4.4 |
| Deflocculant*** | 0.1 | 0.1 | 0.1 | 0.1 | 0.1 | 0.1 |
| Total | 100.00 | 100.00 | 100.00 | 100.00 | 100.00 | 100.00 |

*Alcoa's A-3000FL ($Al_2O_3$-99.8%, $Na_2O$-0.06%, 98% Alpha Phase), Median particle size = 3 micron
**Saint Gobain's 325FOF ($ZrO_2$ + $HfO_2$ = 98.9%), Median particle size = 8 microns
***Spinks 211 sodium polyacrylate The above compositions were then slip cast and fired at a temperature of about 2150° F. and held at temperature for approximately one and a half hours to form the articles. Table 2 below shows the body and surface chemistry for each article formed from compositions 1–6.

TABLE 2

| | #1 | #2 | #3 | #4 | #5 | #6 |
|---|---|---|---|---|---|---|
| Body Chemistry | | | | | | |
| % Alumina* | 1.2 | 9.4 | 39.9 | 64.4 | 34.7 | 39.9 |
| % Silica | 29.0 | 29.9 | 33.5 | 12.1 | 11.0 | 33.5 |
| % Zirconia | 69.3 | 60.2 | 26.1 | 23.0 | 53.8 | 26.1 |
| Surface Chemistry | | | | | | |
| % Zirconia | 94.9 | 83.4 | 37.9 | 37.9 | 83.4 | 37.9 |
| % Alumina* | 1.7 | 13.0 | 58.0 | 58.0 | 13.0 | 58.0 |

*some amount of alumina attributed to clay component

As shown in Table 2, the surfaces of the finished articles were calculated to contain over 90% of the zirconia or blends of alumina and zirconia. As such, the surface of the article is mostly zirconia or a blend of alumina and zirconia while only a small portion of the filler resides on the surface. The interior or body of the article includes the vast majority of the filler mixed with zirconia or a blend of alumina and zirconia.

Although some preferred embodiments have been described, many modifications and variations may be made thereto in light of the above teachings. It is therefore to be recognized that the invention may be practiced otherwise than as specifically described without departing from the inventive concept set forth above.

What is claimed is:

1. A melting vessel, having an integrated contact surface formed thereon, formed from a composition consisting essentially of:

from about 25 to about 99% by weight of a binder material, said binder material consisting essentially of zirconia or a blend of alumina and zirconia;

from about 1 to about 75% by weight of a filler material;

a deflocculant; and wherein at least about 85% of the integrated contact surface of said melting vessel consists of said binder material, said integrated contact surface being non-reactive with molten metals contained within said vessel.

2. The melting vessel of claim 1, wherein at least about 90% of the surface of said melting vessel consists of said binder material.

3. The melting vessel of claim 1, wherein at least about 95% of the surface of said melting vessel consists of said binder material.

4. The melting vessel of claim 1, wherein said binder consists essentially of a blend of alumina and zirconia.

5. The melting vessel of claim 1, wherein the binder consists essentially of zirconia.

6. The melting vessel of claim 1, wherein said binder further includes additional binders.

7. The melting vessel of claim 6, wherein said additional binder is clay.

8. The melting vessel of claim 4, wherein said binder further includes additional binders.

9. The melting vessel of claim 4, wherein said additional binder is clay.

10. The melting vessel of claim 1, wherein said filler material is selected from the group consisting of mullite, fused mullite, silica, fused silica, and mixtures thereof.

11. The melting vessel of claim 10, wherein said filler material has a mesh size from about 4 to about 325 mesh.

12. The melting vessel of claim 4, wherein said alumina has a mean particle size of from about 0.1 to about 10 microns.

13. The melting vessel of claim 1, wherein said zirconia has a mean particle size of from about 0.1 micron to about 20 microns.

14. The melting vessel of claim 4, wherein said alumina has a mean particle size of from about 0.1 to about 10 microns and said zirconia has a mean particle size of from about 0.1 micron to about 20 microns.

15. The melting vessel of claim 1, wherein said binder material includes from about 1% to about 99% by weight of either zirconia or a blend of alumina and zirconia.

16. The melting vessel of claim 1, wherein said binder material further includes from about 1 to about 10% by weight of clay.

17. A melting vessel, having an integrated contact surface formed thereon, formed from a composition consisting essentially of:

from about 60% to about 75% by weight of a binder material, said binder material consisting of alumina, zirconia, and clay;

from about 25% to about 40% by weight of a filler material, said filler material consisting of at least one of fused mullite and fused silica or a blend thereof;

from about 0.01% to about 0.3% of a deflocculant; and wherein at least about 85% of the surface of said melting vessel consists of said binder material, said integrated contact surface being non-reactive with molten metals contained within said vessel.

18. The melting vessel of claim 17, wherein said filler material has a mesh size of from about 4 mesh to about 325 mesh.

19. The melting vessel of claim 17, wherein said alumina has a mean particle size of from about 0.1 micron to about 10 microns.

20. The melting vessel of claim 17, wherein said zirconia has a mean particle size of from about 0.1 micron to about 20 microns.

21. The melting vessel of claim 17, wherein said alumina has a mean particle size of from about 0.1 to about 10 microns and said zirconia has a mean particle size of from about 0.1 micron to about 20 microns.

22. The melting vessel of claim 17, wherein said alumina has a mean particle size of about 3 microns and said zirconia has a mean particle size of about 8 microns.

23. The melting vessel of claim 17, wherein the deflocculant consists of sodium polyacrylate.

* * * * *